US008475121B1

(12) United States Patent
Liang

(10) Patent No.: US 8,475,121 B1
(45) Date of Patent: Jul. 2, 2013

(54) RING SEGMENT FOR INDUSTRIAL GAS TURBINE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 437 days.

(21) Appl. No.: 13/007,764

(22) Filed: Jan. 17, 2011

(51) Int. Cl.
*F01D 11/08* (2006.01)

(52) U.S. Cl.
USPC ..... 415/173.1; 415/115; 415/175; 415/173.4; 416/95; 416/97 R

(58) Field of Classification Search
USPC ..... 415/173.1
See application file for complete search history.

(56) References Cited

U.S. PATENT DOCUMENTS

2004/0047725 A1* 3/2004 Tomita et al. ..... 415/116
2005/0129499 A1* 6/2005 Morris et al. ..... 415/1
2006/0140753 A1* 6/2006 Romanov et al. ..... 415/173.1
2010/0232929 A1* 9/2010 Joe et al. ..... 415/1

* cited by examiner

*Primary Examiner* — Nathaniel Wiehe
*Assistant Examiner* — Eldon Brockman
(74) *Attorney, Agent, or Firm* — John Ryznic

(57) ABSTRACT

A ring segment for a turbine in an industrial gas turbine engine, the ring segment having an inner side with a number of pedestals extending radially inward, each pedestal having an inlet metering hole connected to a diffusion chamber having an opening flush with a TBC covering the pedestals. The pedestals form a larger surface area to secure the TBC to the ring segment so that the TBC can be formed thicker than the prior art without spalling.

10 Claims, 4 Drawing Sheets

RING SEGMENT FOR INDUSTRIAL GAS TURBINE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a ring segment for a turbine in an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A row or stage of turbine rotor blades rotate within an annular arrangement of ring segments in which blade tips form a small gap with an inner or hot surface of each ring segment. The size of the gap changes due to different thermal properties of the blade and the ring segments from a cold sate to a hot state of the turbine. The smaller the gap, the less hot gas leakage will flow between the blade tips and the ring segments.

An IGT engine operates for long periods of time at steady state conditions, as opposed to an aero gas turbine engine that operates for only a few hours before shutting down. Thus, the parts in the IGT engine must be designed for normal operation for these long periods, such as up to 40,000 hours of operation at steady state conditions. A thin TBC (Thermal Barrier Coating) is applied to the inner or hot surface of each ring segment in order to insulate the ring segment from the hot gas flow and reduce the metal temperature of the ring segment. A reduced metal temperature requires less cooling air flow and thus improves the turbine efficiency. As the turbine inlet temperature increases, the cooling flow demand for cooling the ring segments will also increase and therefore reduce the turbine efficiency. One method of reducing the cooling air consumption while allowing for higher turbine inlet temperatures is to use a thicker TBC and film cooling for the ring segments. Thus, the design of the cooling circuit for the ring segments relies more on the endurance of the TBC. Therefore, the TBC becomes the main factor in the design of the ring segment cooling circuit. A problem is that the thicker the TBC the higher the chance of spallation (when pieces of the TBC break away).

BRIEF SUMMARY OF THE INVENTION

An improvement in TBC durability on a cooled ring segment is achieved with the ring segment of the present invention in which the ring segment includes an array of pedestals each with a metering inlet section and a diffusion outlet section that are embedded within the ring segment and open onto the inner or hot surface. These multiple metering and diffusion holes in the pedestals are formed at a normal direction or at a small angle to the inner or hot surface of the ring segment. A TBC applied onto the cooled ring segment inner or hot surface will fill into the pedestals and therefore form an attachment mechanism for the TBC. During engine operation, expansion of the pedestal metal due to an increase of the ring segment metal temperature will function to compress the TBC within the ring segment and better secure the TBC to the ring segment and prevent spallation which increases the useful life of the TBC on the cooled ring segment.

Metering and diffusion of the cooling air flow through the ring segment pedestals will produce convection cooling as well as film cooling for the ring segment. Individual metering and diffusion holes can be sized based on the ring segment gas side pressure distribution in both the streamwise and circumferential directions. Also, each individual metering and diffusion hole can be designed based on the ring segment local external heat load to achieve a desired local metal temperature. The individual metering and diffusion holes are arranged in a staggered array along the ring segment against the mainstream hot gas flow. The ring segment cooling hole design will maximize the use of cooling air for a given ring segment inlet gas temperature and pressure profile.

DETAILED DESCRIPTION OF THE INVENTION

Figure 1:
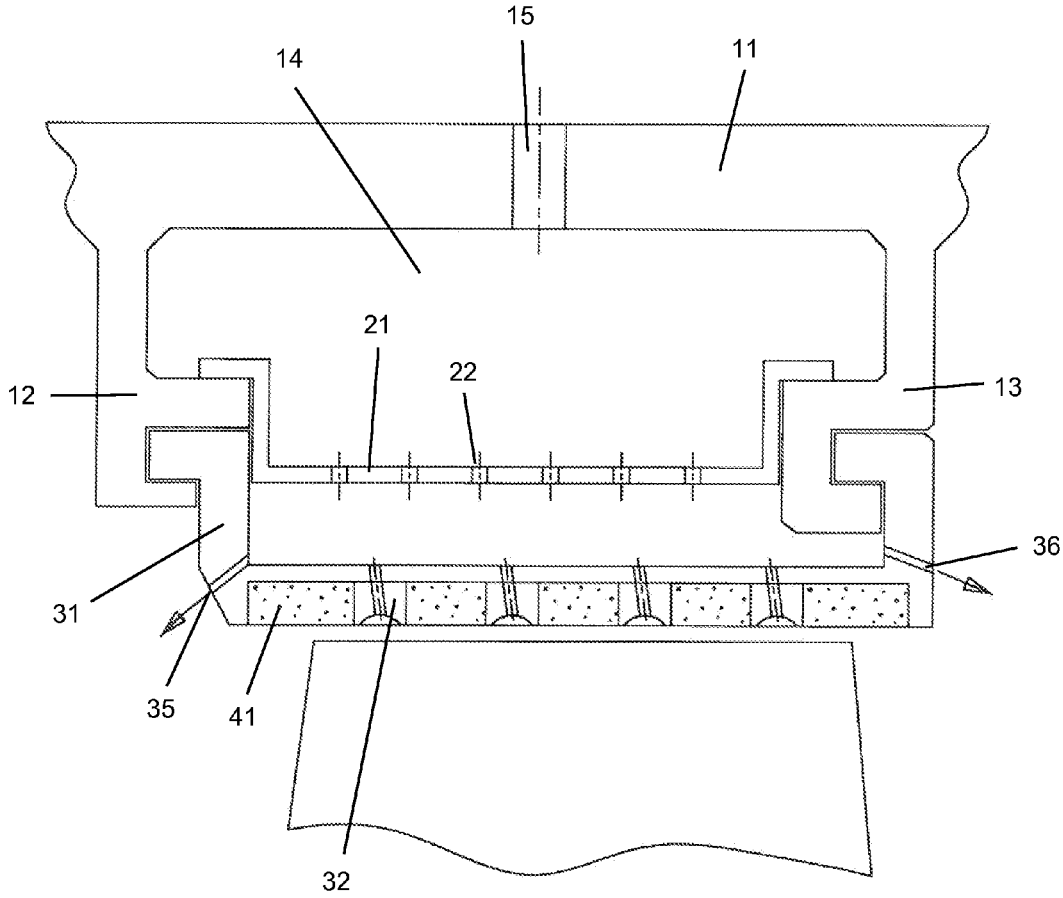
FIG. 1 shows a cross section view of a ring segment mounted in a ring carrier of the present invention.

The ring segment of the present invention is shown in FIG. 1 secured within a blade ring carrier 11. a forward hook 12 and an aft hook 13 extend from the ring carrier 11 and form attachment points for the ring segments 31. A cooling air supply cavity 14 is formed within the ring carrier 11 that is supplied through one or more cooling air feed holes 15. An impingement ring or plate 21 with impingement holes 22 is secured to either the ring carrier 11 or the ring segment upper surface. The ring segment 31 includes leading edge purge air holes 35 and mate face purge air holes 36 on the forward sides and the aft sides of each ring segment 31. The ring segment 31 includes an arrangement of pedestals 32 surrounded by a TBC 41. The inner side of the ring segment includes four sides that form a depression in which the pedestals extend from a bottom of this depression. An opening of the diffusion chambers of the pedestals is flush with the outer ends of the four sides. The TBC fills the space within the depression and around the sides of the pedestals so that the finished inner surface of the ring segment that forms the flowpath for the hot gas stream is flush. Because of the pedestal design for the ring segments, the TBC 41 can be thicker than in the prior art. A rotor blade rotates within the inner or hot surface of the ring segment 31 covered by the TBC 41.

Figure 2:
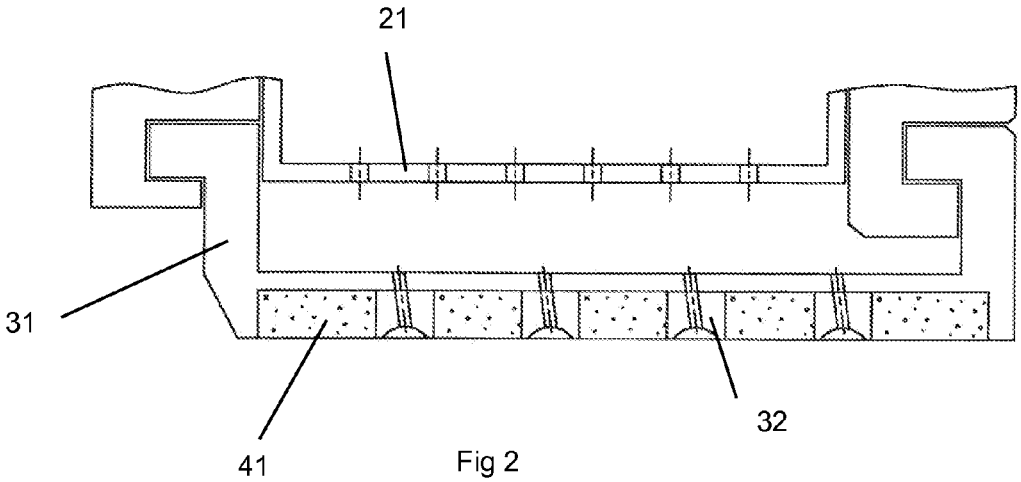
FIG. 2 shows a cross section side view of a ring segment of the present invention.
Figure 3:
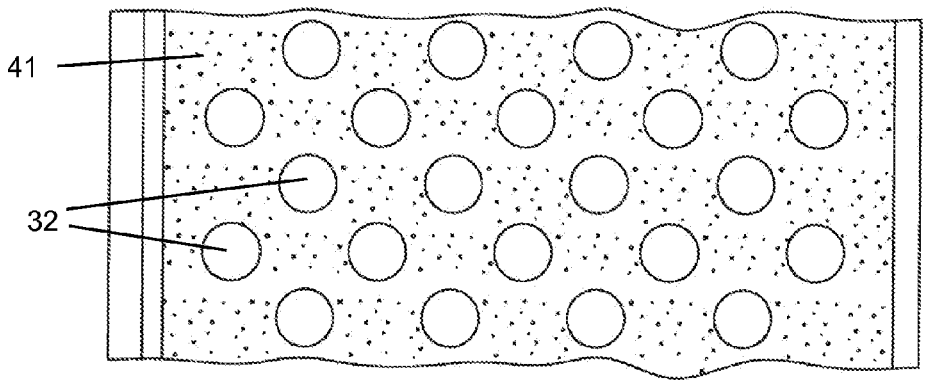
FIG. 3 shows a view of a section of the ring segment of the present invention from the inner or hot surface side.

FIG. 2 shows a side view of the ring segment 31 with the impingement plate 21 over the backside or top surface. The pedestals 32 are arranged on the inner or bottom side and open onto the surface of the TBC 41. FIG. 3 shows the bottom or hot side surface of a section of the ring segment with an arrangement of pedestals 32 with the TBC 41 filled in-between the pedestals 32.

Figure 4:
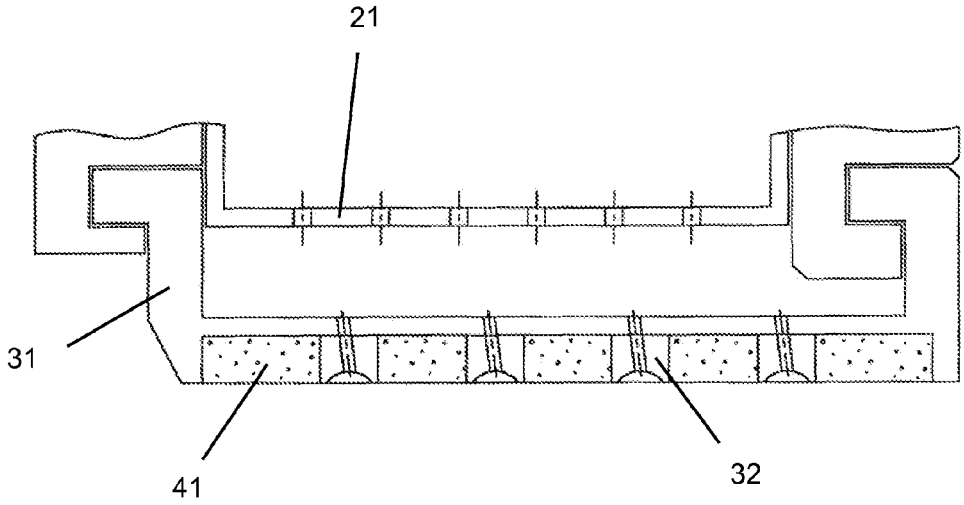
FIG. 4 shows a cross section side view of a ring segment of the present invention with the TBC attachment construction.

FIG. 4 shows a ring segment 31 with each pedestal 32 having a metering inlet hole opening onto the upper or top side of the ring segment and a diffusion section connected to the metering hole and opening onto an inner or hot surface of the ring segment. The TBC 41 covers over the sides of the pedestals so that the opening of the diffusion section is flush with the inner surface of the TBC.

Figure 5:
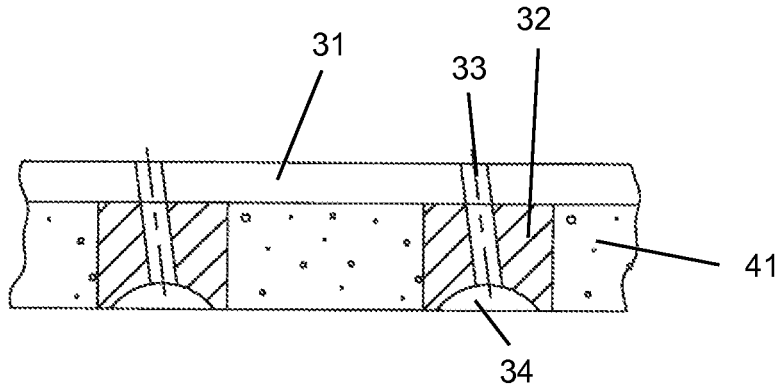
FIG. 5 shows a detailed cross section view of a section of the ring segment with two of the pedestals of the present invention.
Figure 6:
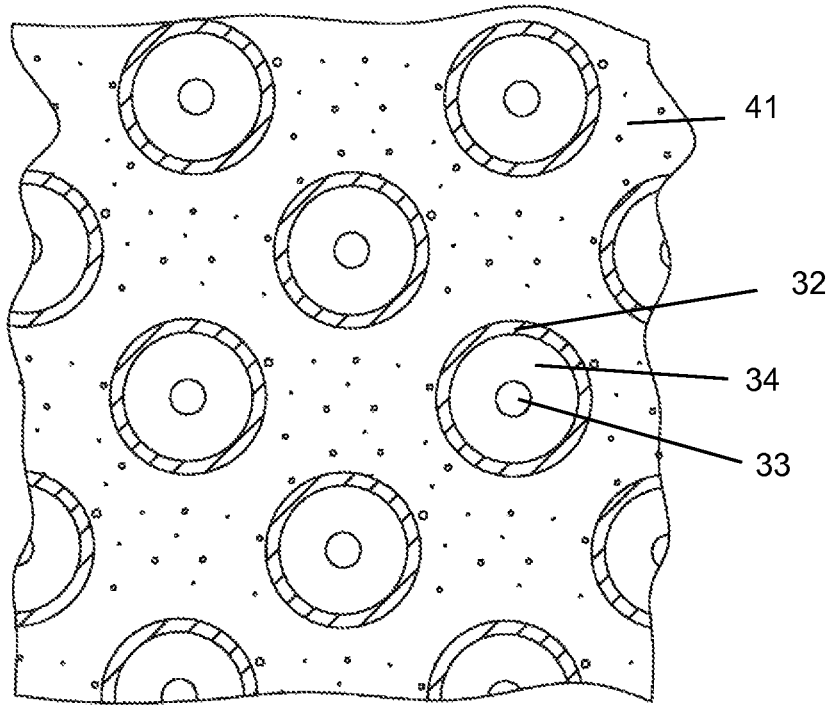
FIG. 6 shows a view of a section of the ring segment of the present invention from the inner or hot surface side with the metering holes and the diffusion section in the pedestals.

FIG. 5 shows a detailed view of the pedestals 32 formed within the TBC 41 on the ring segment 31. Each pedestal 32 extends from an underside of the ring segment 31. The pedestals 32 can be formed as a separate piece from the ring segment 31 and secured individually in position to the ring segment 31, or formed as one piece with the ring segment 31. Each pedestal 31 includes a metering hole 33 that opens onto the inner side of the ring segment 31 and a diffusion section connected to the metering hole 33 and opens onto the surface of the TBC 41. With the pedestals 32 in place on the ring segment 31, the TBC 41 is applied to fill in the areas around the pedestals 32 and form a TBC surface flush with the diffusion section openings. The metering holes 33 extend through the ring segment surface so that the impingement cooling air supplied through the impingement plate 21 can be used to flow through the metering holes 33 and then the diffusion sections 34. FIG. 6 shows the inner or hot side surface of a section of the ring segment 31 with a number of pedestals 32 surrounded by the TBC 41. Each pedestal includes the metering hole 33 opening into the diffusion section 34.

For film cooling, cooling air is metered through each individual pedestal metering hole 33 and then diffused in the semi-circular shaped diffusion cavity 34. This allows for the cooling air to be diffused uniformly into the diffusion cavity prior to being discharged into the hot gas flow path at a reduced cooling air exit momentum in order to maximize the film coverage on the ring segment hot surface. Coolant penetration into the gas path is therefore minimized; yielding a good build-up of the coolant sub-boundary layer next to the ring segment surface. Thus, a better film coverage in the streamwise and circumferential directions for the ring segment is achieved. The combination of multiple hole convection cooling plus diffusion hole film cooling with very high film coverage yields a very high cooling effectiveness and a uniform wall temperature for the ring segment. Also, the diffusion chamber 34 reduces the chance for the metering hole 33 to be plugged as the blade tips rub into the ring segment 31.

Cooling air supplied through the blade ring carrier 11 through cooling air feed holes 15 flows into the cooling air cavity 14 and then through the impingement holes 22 in the impingement plate 21 to produce impingement cooling of the backside surface of the ring segment 31. The spent impingement cooling air is then collected in the impingement cavity (formed between the impingement plate 21 and the ring segment 31) and then flows through the metering holes 33 and the diffusion chambers 34 formed within the pedestals 31.

The amount of cooling air for each individual circumferential and streamwise pedestal 32 is sized based on the local gas side heat load and pressure, which therefore regulates the local cooling performance and the metal temperature of the ring segment. The spent cooling air is metered through the metering holes 33 prior to being discharged through the diffusion chambers 34. With the design of the present invention, the usage of cooling air for a given ring segment inlet gas temperature and pressure profile is maximized. Also, cooling air is metered twice prior to being diffused into the diffusion chambers 34 which allows for the cooling air to generate a very high level of backside convection cooling achieving a uniform cooling for the ring segment. This design also allows for the amount of cooling air discharged at various locations on the ring segment to be controlled. The spent cooling air is discharged from the ring segment as a layer of film cooling air onto the hot surface of the ring segment and the TBC surface.

Major design advantages of the ring segment construction and cooling circuit over the prior art ring segments are described below. The TBC attachment construction increases the TBC effective thickness that results in a higher reduction of ring segment metal temperature or a higher reduction of cooling flow. The series of diffusion chambers on the ring segment surface reduces the ring segment hot side convection surface and thus reduces the heat load on the ring segment. The series of pedestals increases the total bonding surface area for the TBC. During engine operation, the TBC in-between each pedestal is compressed and therefore increases the life and endurance of the TBC. A thicker layer of TBC can be used with less chance of spallation occurring. Multiple metering and diffusion holes are used in the ring segment cooling design. The diffusion chambers located at the exit of the metering holes reduces the film hole plugging issues associated with prior art film cooling holes.

I claim the following:

1. A ring segment for a turbine in an industrial gas turbine engine, the ring segment comprising:

a back side surface forming an impingement cooling;

an inner surface having a plurality of pedestals extending outward;

each of the pedestals having an inlet metering hole and an outlet diffusion chamber; and, a thermal barrier coating covering the sides of the pedestals with an opening of the outlet diffusion chambers being flush with a surface of the thermal barrier coating.

2. The ring segment of claim 1, and further comprising:

the pedestals are circular in cross sectional shape; and, the outlet diffusion chambers are semi-circular in cross sectional shape.

3. The ring segment of claim 1, and further comprising:

an axis of the metering holes is either normal or slightly angled to the inner surface.

4. The ring segment of claim 1, and further comprising:

an opening of the diffusion chambers has a circular cross sectional shape.

5. The ring segment of claim 1, and further comprising:

the inner surface of the ring segment has four sides with radially inner surfaces that form a depression;

the pedestals extend from a bottom surface of the depression; and, the radially inner surfaces of the four sides and openings of the diffusion chambers of the pedestals and the surface of the thermal barrier coating are all flush.

6. An industrial gas turbine engine comprising:

a turbine with a stage of rotor blades each having a blade tip;

a blade outer air seal forming a seal with the blade tips;

the blade outer air seal being formed from multiple ring segments;

each ring segment having an inner side with a plurality of pedestals extending radially inward;

each pedestal having an inlet metering hole connected to a diffusion chamber with an outlet opening; and, a thermal barrier coating formed around the pedestals with the thermal barrier coating surface being flush with the outlet openings of the diffusion chambers.

7. The industrial gas turbine engine of claim 6, and further comprising:

the pedestals are circular in cross sectional shape; and, the diffusion chambers are semi-circular in cross sectional shape.

8. The industrial gas turbine engine of claim 6, and further comprising:

an axis of the metering holes is either normal or slightly angled to the ring segment inner side.

9. The industrial gas turbine engine of claim 6, and further comprising:

an opening of the diffusion chambers has a circular cross sectional shape.

10. The industrial gas turbine engine of claim 6, and further comprising:

the inner surface of the ring segment has four sides with radially inner surfaces that form a depression;

the pedestals extend from a bottom surface of the depression; and, the radially inner surfaces of the four sides and openings of the diffusion chambers of the pedestals and the surface of the thermal barrier coating are all flush.

* * * * *